US006695059B2

(12) United States Patent
Thomas et al.

(10) Patent No.: US 6,695,059 B2
(45) Date of Patent: Feb. 24, 2004

(54) MECHANICAL ANTI-ROTATIONAL FEATURE FOR SUBSEA WELLHEAD HOUSING

(75) Inventors: Sean P. Thomas, Houston, TX (US); Hernani G. Deocampo, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 22 days.

(21) Appl. No.: 10/027,468

(22) Filed: Oct. 22, 2001

(65) Prior Publication Data

US 2002/0144820 A1 Oct. 10, 2002

Related U.S. Application Data

(60) Provisional application No. 60/242,469, filed on Oct. 23, 2000.

(51) Int. Cl.[7] ..... E21B 33/035

(52) U.S. Cl. ..... 166/368; 166/382; 166/208

(58) Field of Search ..... 166/208, 209, 166/211, 212, 382, 181, 387, 348, 368

(56) References Cited

U.S. PATENT DOCUMENTS 4,519,633 A * 5/1985 Nichols ..... 285/3
4,615,544 A * 10/1986 Baugh ..... 285/18
4,681,166 A * 7/1987 Cuiper ..... 166/345
4,691,780 A * 9/1987 Galle et al. ..... 166/348
4,902,047 A 2/1990 Marietta et al.
5,240,081 A * 8/1993 Milberger et al. ..... 175/8
5,290,126 A 3/1994 Gariepy et al.
5,360,063 A * 11/1994 Henderson, Jr. ..... 166/208
5,544,707 A * 8/1996 Hopper et al. ..... 166/382
6,041,859 A * 3/2000 Blades ..... 166/208

* cited by examiner

*Primary Examiner*—Frank Tsay
(74) *Attorney, Agent, or Firm*—Bracewell & Patterson, L.L.P.

(57) ABSTRACT

An anti-rotation device prevents an inner wellhead housing from rotating within an outer wellhead housing. The anti-rotation device provides spring loaded anti-rotational keys within the outer wellhead housing and mating slots formed within the inner wellhead housing. The keys face inwards to the inner wellhead housing, are circumferentially spaced apart around the outer wellhead housing, and located between the two tapered shoulders. As the inner wellhead housing lands in the outer housing, the inner wellhead housing pushes the keys of the outer wellhead housing to a retracted position. The inner wellhead housing is then rotated within the outer wellhead housing until the spring loaded keys align with the slots and extend into the slots of the inner wellhead housing. Any rotational force on the inner wellhead housing will be resisted by the anti-rotational mechanism.

19 Claims, 4 Drawing Sheets

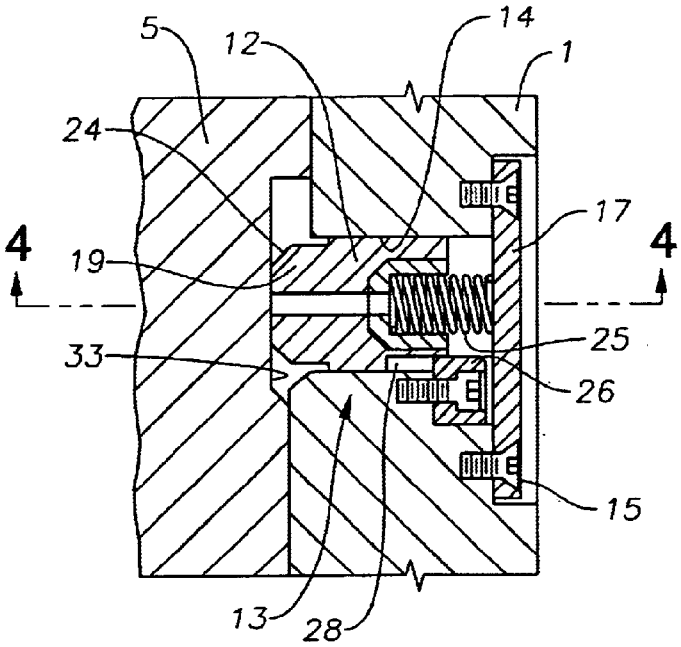
Fig. 2
Fig. 3
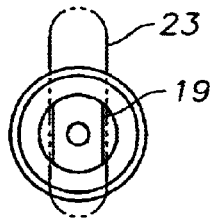
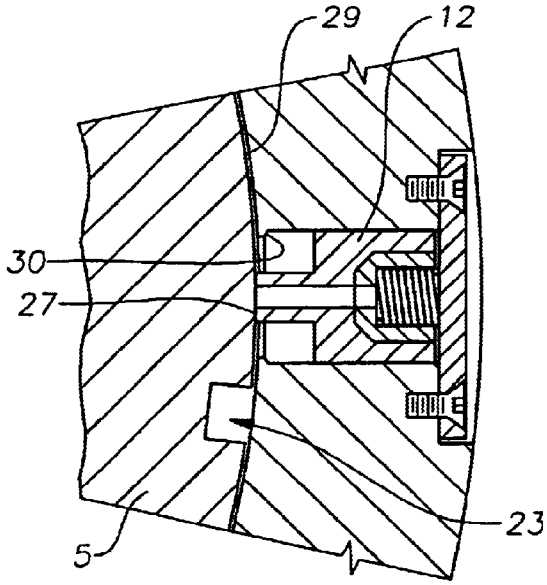
Fig. 4

MECHANICAL ANTI-ROTATIONAL FEATURE FOR SUBSEA WELLHEAD HOUSING

CROSS REFERENCE TO RELATED APPLICATIONS

The present application is related to provisional application U.S. Patent Application Serial No. 60/242,469 "MECHANICAL ANTI-ROTATIONAL FEATURE FOR SUBSEA WELLHEAD HOUSING filed on Oct. 23, 2000, assigned to the assignee of the present application and incorporated herein by reference.

BACKGROUND OF THE INVENTION

1. Field of the Invention

This invention relates in general to subsea well drilling, and in particular to a means for preventing an inner wellhead housing secured to the lower end of a riser suspended from a drilling vessel from rotating within a conductor or an outer wellhead housing.

2. Description of the Related Art

Many subsea wells are drilled by first drilling a large diameter hole, then installing a string of conductor pipe, which has an outer wellhead housing secured to the upper end. Then, the operator drills the well to a greater depth and installs a first string of casing. An inner wellhead housing secures to the upper end of the string of casing and lands within the outer wellhead housing. The operator will then drill the well to a further depth. A string of riser will extend from the inner wellhead housing to the drilling vessel.

A floating drilling vessel can cause rotational forces on the riser. Normally, the rotation is resisted by frictional engagement of the landing shoulders of the inner wellhead housing and the outer wellhead housing. If the rotational force is high enough to cause the inner wellhead housing to begin to rotate within the outer wellhead housing, one of the casing joints below the inner wellhead housing could start to unscrew, causing a serious problem.

SUMMARY OF THE INVENTION

An anti-rotation device is provided to prevent an inner wellhead housing from rotating within an outer wellhead housing. The anti-rotation device includes providing a plurality of anti-rotational keys between the inner and outer wellhead housing. In a first embodiment the keys face inwards to the inner wellhead housing and are circumferentially spaced apart around the outer wellhead housing located between the two tapered shoulders. The anti-rotational device additionally includes providing a plurality of anti-rotational mating slots located on the exterior of the inner wellhead housing. The plurality of keys are spring loaded and extend radially outward from the outer wellhead housing in an extended position. As the inner wellhead housing lands in the outer housing, the inner wellhead housing pushes the keys of the outer wellhead housing into a retracted position. The inner wellhead housing is then rotated within the outer wellhead housing until the spring loaded keys align with the slots and extend into the slots of the inner wellhead housing. Any rotational force on the inner wellhead housing will be resisted by the anti-rotational mechanism. The control of rotational resistance may be controlled be varying the number keys and slots.

In the second embodiment, the keys face outwards to the outer wellhead housing and are circumferentially spaced apart around the inner wellhead housing located between the two tapered shoulders. The anti-rotational device additionally includes providing a plurality of anti-rotational mating slots located on the interior of the outer wellhead housing. The plurality of keys are spring loaded and extend radially outward from the inner wellhead housing in an extended position. As the inner wellhead housing lands in the outer housing, the outer wellhead housing pushes the keys of the inner wellhead housing into a retracted position. The inner wellhead housing is then rotated within the outer wellhead housing until the spring loaded keys align with the slots and extend into the slots of the outer wellhead housing. Any rotational force on the inner wellhead housing will be resisted by the anti-rotational mechanism. The control of rotational resistance may be controlled be varying the number keys and slots.

BRIEF DESCRIPTION OF THE DRAWINGS

FIG. 2 is a sectional detail view of a passive anti-rotational mechanism of the wellhead system of FIG. 1.

FIG. 3 is a detail view of a nose slot and the nose of the anti-rotational mechanism of FIG. 2.

FIG. 4 is a top sectional detail view of the passive anti-rotational mechanism of FIG. 2 taken along the line 4—4 of FIG. 2, and shows the inner wellhead housing misaligned.

DETAILED DESCRIPTION OF THE PREFERRED EMBODIMENTS

Figure 1:
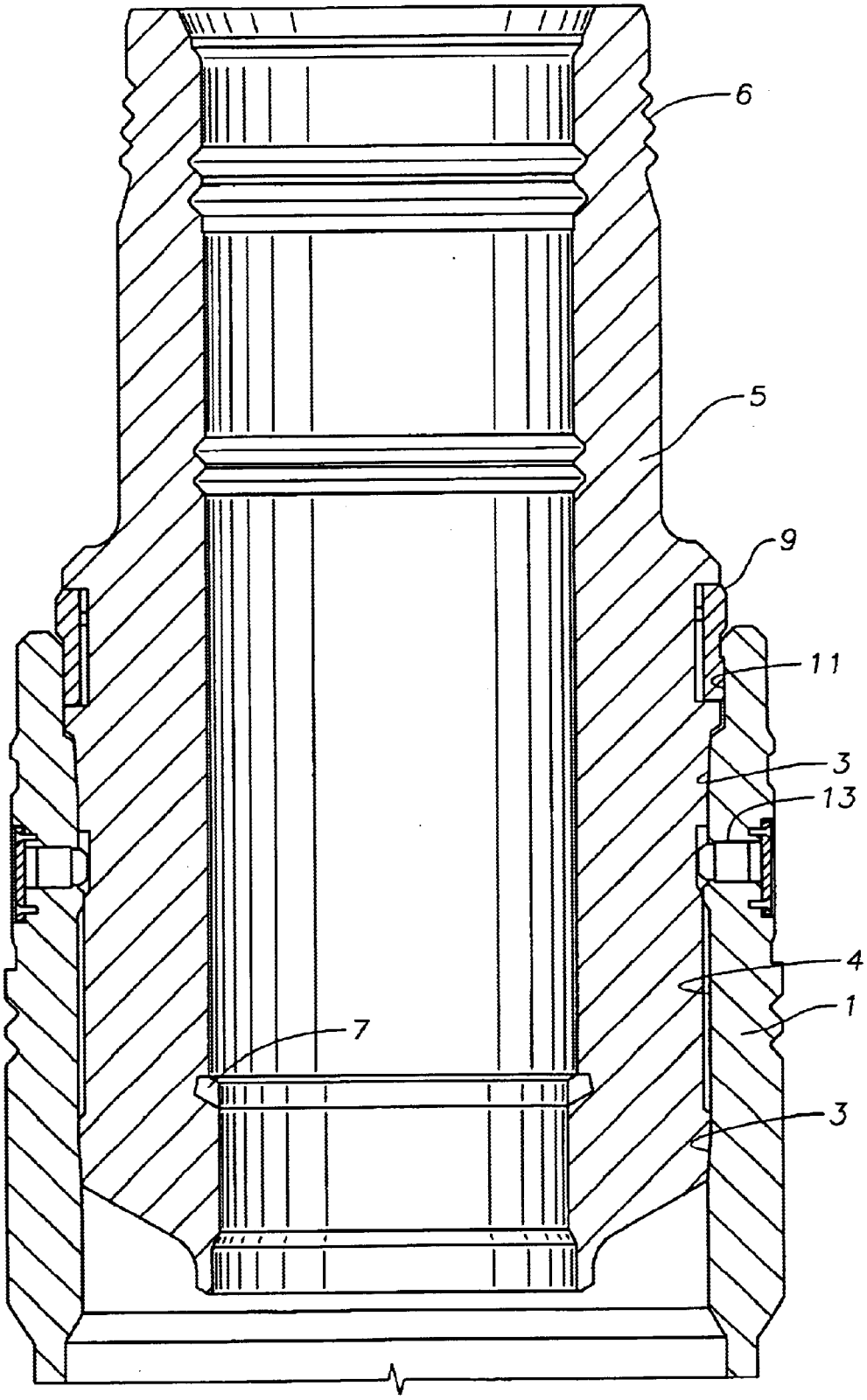
FIG. 1 is a sectional elevation view of wellhead system constructed in accordance with this invention.

Referring to FIG. 1, an outer wellhead housing 1 will be installed at the sea floor. Outer wellhead housing 1 is a large tubular member secured to a string of conductor pipe (not shown). The conductor pipe extends into the well and will be cemented in place. Outer wellhead housing 1 has an axial bore 4. Two tapered, axially spaced apart landing shoulders 3 are located in the bore 4 in the outer wellhead housing 1.

An inner wellhead housing 5 will land in outer wellhead housing 1. The lower end of inner wellhead housing 5 secures to a string of casing (not shown) which extends into the well and is cemented in place. During cementing, returns will flow out ports (shown as ports 43 in FIG. 6) in outer wellhead housing 1. The upper end of inner wellhead housing 5 protrudes above the upper end of outer wellhead housing 1 and has an external grooved profile 6 that will connect to a string of riser (not shown) which extends upward to a drilling vessel. Inner wellhead housing 5 has an external downward facing conical landing shoulder. Landing shoulder mates with and is supported on internal landing shoulder. The inner wellhead housing 5 has mating shoulders that engage the tapered shoulders 3 in a wedging action. A spring biased latch 9 on inner wellhead housing 5 snaps outward to engage groove 11 in bore 4 to retain inner wellhead housing 5 in outer wellhead housing 1. Inner wellhead housing 5 has a bore with a landing shoulder 7 for receiving a casing hanger.

A plurality of anti-rotational mechanisms 13 are positioned within the outer wellhead housing 1 for preventing rotation of the inner wellhead housing 5 relative to the outer wellhead housing 1. The anti-rotation mechanisms 13 are circumferentially spaced apart around the outer wellhead housing 1, and each anti-rotational mechanisms 13 is located between the two tapered shoulders 3. Referring to FIG. 2, each anti-rotational mechanism 13 has a cylindrical key body 12 slidably carried within a cylindrical hole 14 in the outer wellhead housing 1. Hole 14 extends completely through the sidewall of the outer wellhead housing 1. A plurality of screws 15 secure a baseplate 17 to the outer side of hole 14. A spring loaded key 19 is rigidly formed on the inner end of body 12. Key 19 will extend out once the anti-rotational mechanism 13 interfaces with a mating slot 23 found on the exterior of the inner wellhead housing 5. Each key 19 is rectangular in shape having a beveled outer edge which assists each key 19 with engaging the mating slot 23.

The extension of each key 19 is caused by the coil spring 25 contained within the anti-rotational mechanism 13. The base of each coil spring 25 is attached to the baseplate 17 and the inner end is attached with key body 12. The coil spring 25 remains compressed until the key 19 interfaces a mating slot 23. At the point of engagement between a key 19 and a mating slot 23 the coil spring 25 will extend linearly in the direction of its bias. A stationary key 26 engages slot 28 in key body 12 to prevent key body 12 from rotating. Stationary key 26 is mounted to the outer wellhead housing on a lower side of hole 14. A shoulder 30 (FIG. 4) formed in hole 14 retains key body 12 in hole 14.

As seen in FIG. 4 prior to landing the inner wellhead housing 5 fully into the outer wellhead housing 1, the inner wellhead housing 5 is rotated. Keys 19 remain in the retracted position with the outer edge 27 of the key 19 riding flush against the exterior 29 of the inner wellhead housing 5. As the matching profiles interface, the keys 19 spring out and engage the mating slot 23, thus securing the inner wellhead housing 5 in an anti-rotating state.

The matting slots 23 and keys 19 are of proportional height and width, allowing each key 19 to fasten easily into the larger mating slot 23. As shown in FIG. 3, the width of each slot 23 is greater than the width of each key 19.

In operation, the operator will install the outer wellhead housing 1 conventionally. The operator will secure the inner wellhead housing 5 to a string of riser and lower the inner wellhead housing 5 into the bore 4 of the outer wellhead housing 1. The operator rotates the riser and inner wellhead housing 5 until the keys 19 align with the mating slots 23, at which time the keys 19 extend into the mating slots 23. Subsequently, any rotational force on the riser and inner wellhead housing 5 will be resisted by the anti-rotational mechanism. By varying the number of keys 19 and mating slots 23 the amount of relative rotation and torsional can be controlled.

Figure 5:
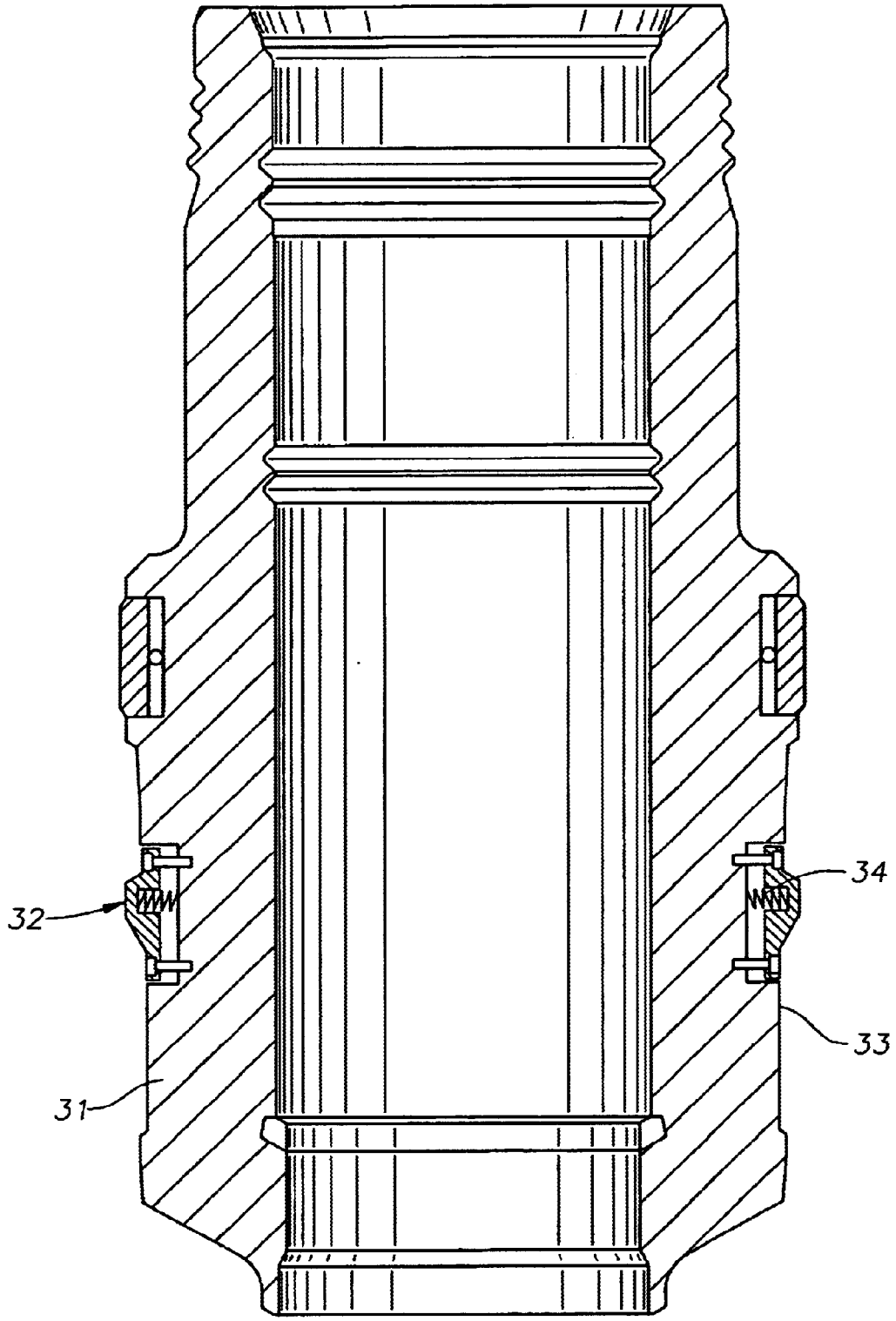
FIG. 5 is a sectional elevation view of an inner wellhead housing having an alternative embodiment of an anti-rotational mechanism.
Figure 6:
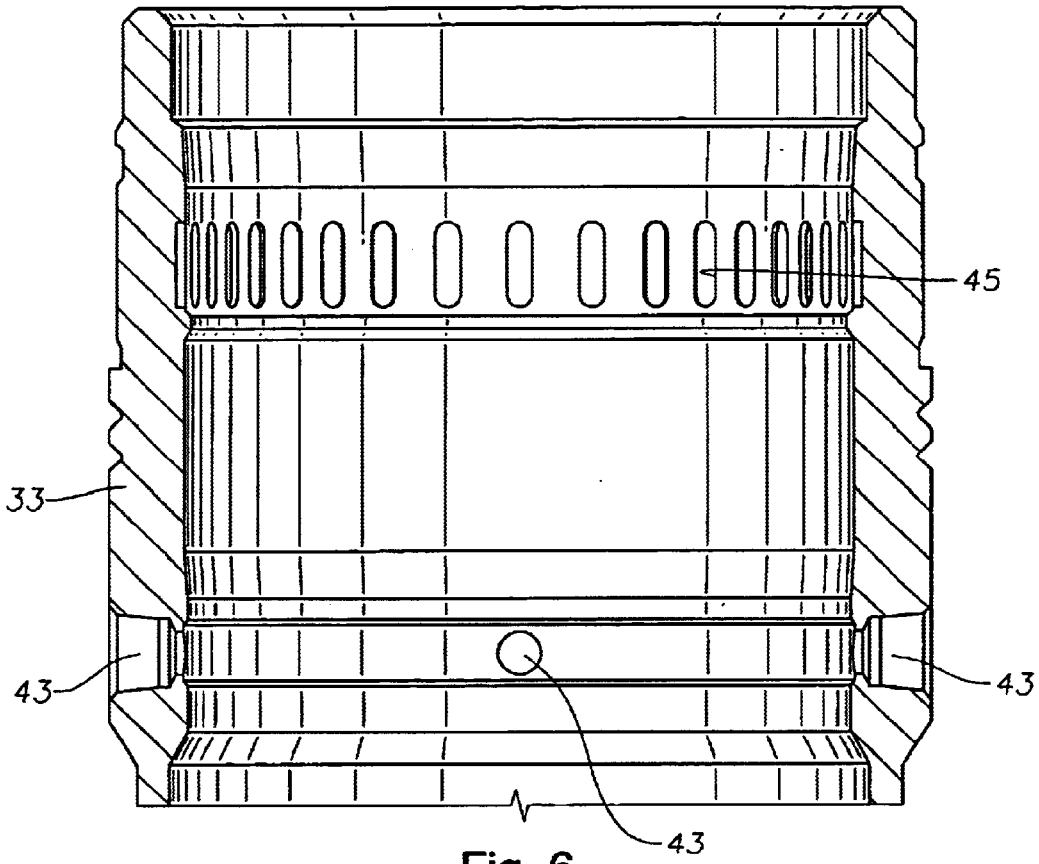
FIG. 6 is a sectional elevation view of an outer wellhead housing having slots for receiving the anti-rotational mechanism of FIG. 5.

Illustrative in FIG. 5, an alternative embodiment a plurality of anti-rotational mechanisms 32 are positioned within the inner wellhead housing 31 for preventing rotation of the inner wellhead housing 31 relative to the outer wellhead housing 33 (FIG. 6). The anti-rotation mechanisms 32 are circumferentially spaced apart around the inner wellhead housing 31, and each anti-rotational mechanisms 32 is located between the two tapered shoulders. Each anti-rotational mechanism 32 comprises a key 34 biased outward by a spring 35. Key 34 will extend out once the anti-rotational mechanism 32 interfaces with a mating slot 45 found on the interior of the outer wellhead housing 33. Each key 34 is rectangular in shapes having a beveled outer edge which assists each key 34 with engaging the mating slot 45.

FIG. 6 also shows ports 43 in outer wellhead housing 33. Ports 43 extend through the sidewall of outer wellhead housing 33 below slots 45. Ports 43 communicate the bore of outer wellhead housing 33 with sea water.

Prior to landing the inner wellhead housing 31 fully into the outer wellhead housing 33, the inner wellhead housing 31 is rotated. Keys 34 remain in the retracted position with the outer edge of the key 34 riding flush against the bore of the outer wellhead housing 33. As the matching profiles interface, the keys 34 spring out and engage the mating slots 45, thus securing the inner wellhead housing 31 in an anti-rotating state.

The mating slots 45 and keys 34 are of proportional height and width, allowing each key 34 to fasten easily into the larger mating slot 45. As shown in FIG. 3, the width of each slot 45 is greater than the width of each key 34.

In operation, the operator will install the outer wellhead housing 33 conventionally. The operator will secure the inner wellhead housing 31 to a string of riser and lower the inner wellhead housing 31 into the bore of the outer wellhead housing 33. The operator rotates the riser and inner wellhead housing 31 until the keys 34 align with the mating slots 45, at which time the keys 34 extend into the mating slots 45. Subsequently, any rotational force on the riser and inner wellhead housing 31 will be resisted by the anti-rotational mechanism. By varying the number of keys 34 and mating slots 45 the amount of relative rotation and torsion can be controlled.

The invention has significant advantages. The anti-rotation device prevents rotation of the inner wellhead housing relative to the outer wellhead housing. The device is simple and rugged.

While the invention has been shown in only two of its forms, it should be apparent to those skilled in the art that it is not so limited, but is susceptible to various changes without departing from the scope of the invention.

What is claimed is:

1. In a subsea well assembly having an outer wellhead housing adapted to be located at a sea floor, an inner wellhead housing which lands in the outer wellhead housing, the inner wellhead housing having an upper end that protrudes above the outer wellhead housing, the inner wellhead housing having a grooved profile extending circumferentially around an exterior portion of the upper end for connection to a riser leading upward to a surface vessel, an improved anti-rotation device for preventing rotation of the inner wellhead housing in the outer wellhead housing comprising in combination:

at least one slot formed in a sidewall of one of the wellhead housings; and at least one key secured to a sidewall of the other of the wellhead housings, the key being received in the slot when the inner wellhead housing lands in the outer wellhead housing at the sea floor.

2. The subsea well assembly according to claim 1 wherein the slot is in the sidewall of the inner wellhead housing and the key is in the sidewall of the outer wellhead housing.

3. The subsea well assembly according to claim 1 wherein the slot is in the sidewall of the outer wellhead housing and the key is in the sidewall of the inner wellhead housing.

4. The subsea well assembly according to claim 1 wherein the slot has opposed edge portions that are parallel and circumferentially spaced apart from each other.

5. The subsea well assembly according to claim 1 wherein the key is spring loaded and moves between a retracted and an extended position.

6. The subsea well assembly according to claim 1 wherein the inner wellhead housing has a bore with a load shoulder therein for receiving a casing hanger.

7. The subsea well assembly according to claim 1 further comprising a latch on the inner wellhead housing above the key, the latch engaging the outer wellhead housing to prevent upward movement of the inner wellhead housing relative to the outer wellhead housing.

8. The subsea well assembly according to claim 1, wherein the outer wellhead housing has an open upper end that is adapted to expose an upper portion of the bore of the outer wellhead housing to sea water.

9. The sub sea well assembly according to claim 1, wherein the outer wellhead housing has a plurality of ports extending therethrough that are open so as to expose an interior portion of the outer wellhead housing to sea water.

10. A subsea well assembly, comprising in combination:

an outer wellhead housing adapted to be located at a sea floor;

a plurality of keys spaced apart from each other around the outer wellhead housing;

a spring engaging each of the keys to push the keys inward to an extended position;

an inner wellhead housing located in the outer wellhead housing the inner wellhead housing having an upper end that protrudes above the outer wellhead housing, the upper end of the inner wellhead housing having an external grooved profile for connection to a riser leading from the inner wellhead housing to a vessel at the surface; and a plurality of slots formed in and spaced apart from each other around the inner wellhead housing, each of the keys locating in one of the slots to prevent rotation of the inner wellhead housing in the outer wellhead housing.

11. The subsea well assembly according to claim 10 further comprising a latch that secures the inner wellhead housing to the outer wellhead housing, the latch being located above the keys.

12. The subsea well assembly according to claim 8 further comprising a plurality of holes extending through the outer wellhead housing below the keys for communicating an interior portion of the outer wellhead housing with the sea.

13. The subsea well assembly according to claim 10 wherein the outer well head housing has a cylindrical hole located in the sidewall and the keys have a cylindrical body that is slidably carried in the hole, each of the keys having an inner end that is rectangular for engaging one of the slots.

14. An improved method for preventing rotation of an inner wellhead housing in an outer wellhead housing, the outer wellhead housing being located at a sea floor, the inner wellhead housing having an upper end that protrudes above an upper end of the outer wellhead housing, the upper end of the inner wellhead housing having an external grooved profile for connection to a riser leading from the inner wellhead housing to a vessel at the surface, method comprising:

providing at least one slot in a sidewall of one of the wellhead housings;

securing at least one key to a sidewall of the other of the wellhead housings; then lowering the inner wellhead housing into the outer wellhead housing, and causing the inner wellhead housing to rotate a limited amount if necessary until the key registers with the slot, restraining the inner wellhead housing from all rotation relative to the outer wellhead housing.

15. The method according to claim 14 wherein the step of securing at least one key to the sidewall of one of the wellhead housing further comprises:

positioning the key in a hole for movement between retracted and extended positions; and engaging the key to the extended position with a spring, and the step of lowering the inner wellhead housing into the outer wellhead housing comprises causing the key to move into the retracted position until engaging the slot.

16. A subsea well assembly, comprising in combination:

an outer wellhead housing adapted to be located at a sea floor and having a bore with an open upper end;

an inner wellhead housing located in the bore of the outer wellhead housing, the inner wellhead housing having an upper end that protrudes above the upper end of the outer wellhead housing and has an exterior grooved profile for connection to a riser leading to a vessel at the surface;

a plurality of keys spaced apart from each other around the inner wellhead housing, each of the keys being movable between a retracted and extended positions;

a spring engaging each of the keys to push the keys outward to the extended position; and a plurality of slots formed in and spaced apart from each other around the outer wellhead housing, each of the keys locating in one of the slots to prevent rotation of the inner wellhead housing in the outer wellhead housing.

17. The subsea well assembly according to claim 16 further comprising a latch at the upper end of the outer wellhead housing that secures to the inner wellhead housing above the keys to prevent upward motion of the inner wellhead housing relative to the outer wellhead housing.

18. The subsea well assembly according to claim 16 further comprising a plurality of holes in the outer wellhead housing below the keys for communicating the bore of the outer wellhead housing to the sea.

19. The subsea well assembly according to claim 16 wherein the inner wellhead housing has a has a bore containing a load shoulder for receiving a casing hanger.

* * * * *

UNITED STATES PATENT AND TRADEMARK OFFICE

CERTIFICATE OF CORRECTION

PATENT NO. : 6,695,059 B2
DATED : February 24, 2004
INVENTOR(S) : Sean P. Thomas et al.

It is certified that error appears in the above-identified patent and that said Letters Patent is hereby corrected as shown below:

Column 3,
Line 35, delete “slot” and insert -- slots --
Line 66, delete “shapes” and insert -- shape --

Column 5,
Line 13, delete “sub sea” and insert -- subsea --
Line 24, after “housing” and before “the inner” insert a comma -- , --
Line 39, after “claim” and before “further” delete “8” and insert -- 10 --
Line 44, delete “well head” and insert -- wellhead --

Column 6,
Line 34, after “between” and before “retracted” delete “a”

Signed and Sealed this

Sixth Day of July, 2004

JON W. DUDAS
*Acting Director of the United States Patent and Trademark Office*